United States Patent [19]

Brandes

[11] 4,190,245

[45] Feb. 26, 1980

[54] DE-CURLING DEVICE FOR PRINTING PRESSES

[75] Inventor: Harry Brandes, Hainburg, Fed. Rep. of Germany

[73] Assignee: Roland Offsetmaschinenfabrik Faber & Schleicher AG, Fed. Rep. of Germany

[21] Appl. No.: 843,260

[22] Filed: Oct. 14, 1977

[30] Foreign Application Priority Data

Oct. 28, 1976 [DE] Fed. Rep. of Germany ..... 2648986

[51] Int. Cl.[2] ..... B65H 29/70

[52] U.S. Cl. ..... 271/278; 72/54; 72/160; 101/232; 162/271; 271/183

[58] Field of Search ..... 271/63, 183, 238, 204–206, 271/231, 240; 101/420, 422, 232; 162/271, 270; 38/143; 226/195; 72/54, 160; 242/75.2

[56] References Cited

U.S. PATENT DOCUMENTS

| | | | |
|---|---|---|---|
| 2,740,355 | 4/1956 | Wimpfheimer | 101/420 |
| 3,076,492 | 2/1963 | Monks | 271/63 X |
| 3,791,644 | 2/1974 | DeMoore | 101/422 X |
| 4,002,047 | 1/1977 | MacPhee et al. | 271/63 X |
| 4,013,284 | 3/1977 | DeMetre | 271/63 X |
| 4,060,236 | 11/1977 | Carsteot | 271/183 |

FOREIGN PATENT DOCUMENTS

| | | | |
|---|---|---|---|
| 7500754 | 9/1975 | Netherlands | 271/183 |

*Primary Examiner*—Bruce H. Stoner, Jr.
*Attorney, Agent, or Firm*—Leydig, Voit, Osann, Mayer & Holt, Ltd.

[57] ABSTRACT

A sheet flattener for a sheet-fed printing press or the like in which sheets having a tendency to curl are conveyed edgewise from a source to a receiver along a path of flow. A pair of cylindrical members, or rollers, define between them a receiving space which extends crosswise with respect to the direction of sheet movement. A vacuum is applied in the receiving space so that a conveyed sheet is drawn against the rollers in a cusped profile, undergoing an abrupt bend at the point of the cusp in a direction opposite to the direction of curling tendency so that the curl is neutralized. At least the downstream one of the roller is mounted for rotational movement at the speed of the sheet thereby to reduce the frictional drag of the sheet. In the preferred embodiment both rollers are mounted for rotation and the surfaces thereof are roughened with a two-dimensional pattern of shallow projections to minimize contact with the surface of the sheet and to prevent relative slippage. In a further embodiment, both of the rollers are positively driven at a peripheral speed which corresponds to the speed of conveyance to prevent periodic slowdown of the rollers between successive sheets and to thus further insure against slippage between the sheet and roller surfaces.

2 Claims, 7 Drawing Figures

FIG. 1
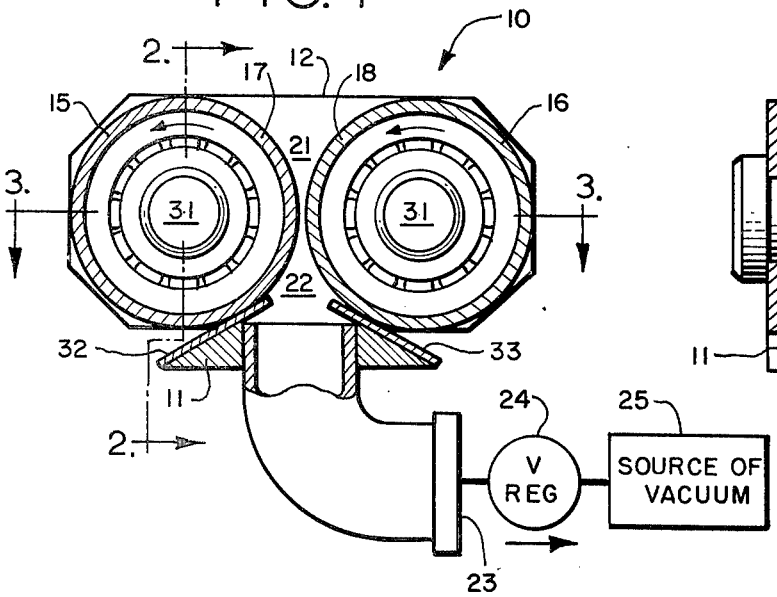
FIG. 2
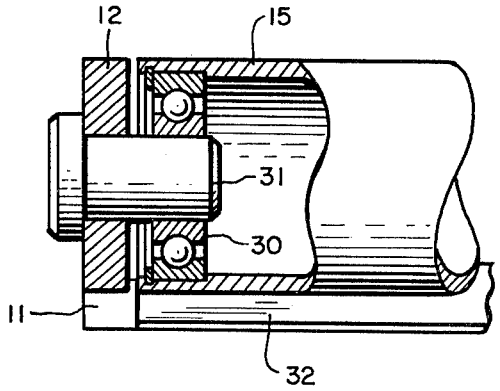
FIG. 5
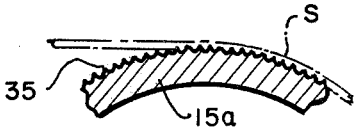
FIG. 3
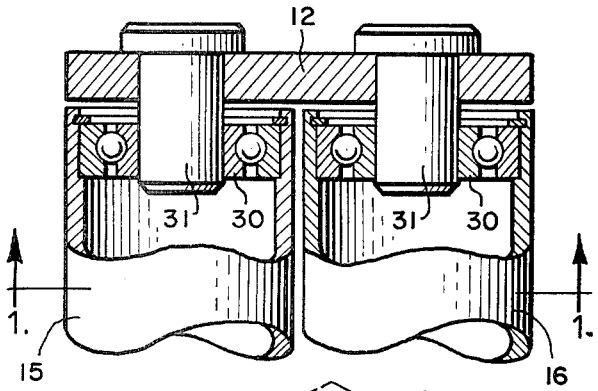
FIG. 6
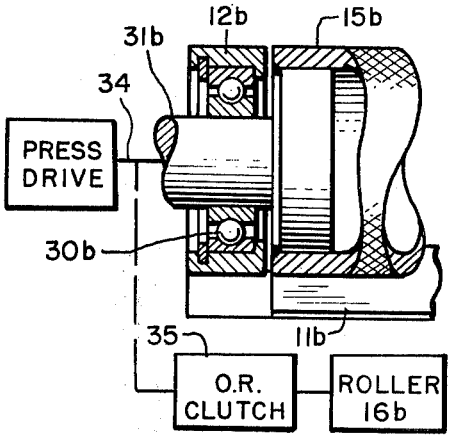
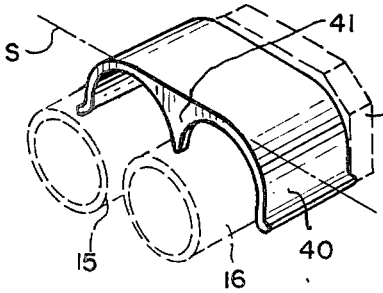
FIG. 7
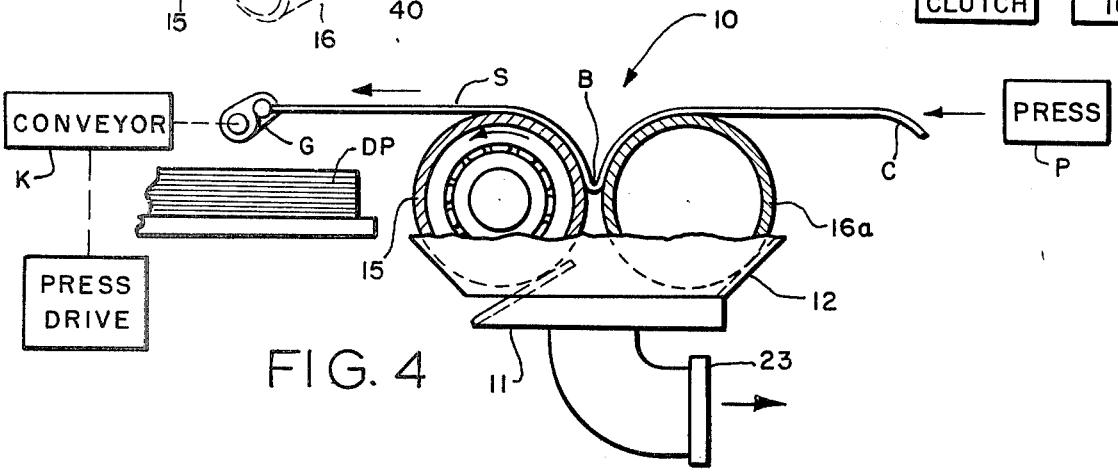
FIG. 4

DE-CURLING DEVICE FOR PRINTING PRESSES

Sheets fed from a lithographic printing press have a tendency to curl because of their physical treatment in the press and due to the moisture applied to the printed side. Such curling causes a "rolling-in", especially at the trailing edge of the sheet, and interferes with neat stacking of the sheets in a pile. Under certain circumstances the "rolling-in" effect may be so pronounced that the rear edge of the sheet becomes "folded in" as it is deposited on the pile. Efforts have been made to solve the curling problem as evidenced by German Disclosure Specification DT-OS No. 2,345,900 published Nov. 28, 1974. In this disclosure a passing sheet is drawn downwardly, by vacuum, into a V-shaped groove which extends transversely of the direction of sheet movement. The problem with such a device is that upon applying sufficient suction to seat the sheet in the groove, a high degree of friction is produced between the sheet and the engaged surfaces. This causes undesirable stretching of the sheet; indeed, the force of friction may become so great that the sheet is pulled out of the grippers which convey it. Conventional de-curlers suffer from the further disadvantage that they cannot be used effectively with sheets printed on both sides because of the smearing of the ink on the engaged side.

In an effort to alleviate these undesirable effects, vacuum is reduced, often to a level at which little or no de-curling effect is obtained.

Accordingly, it is an object of the invention to provide a sheet flattening, or de-curling, device having a high degree of de-curling effect combined with a low degree of friction and which therefore enables the sheet to be drawn along the de-curling path with only light forces upon the grippers and without noticeable stretching of the sheet.

It is another object of the present invention to provide a de-curling device using rollers which are freely rotatable and which therefore avoid any relative slippage between the sheet and the engaged de-curling surfaces. It is, accordingly, an object of the invention to provide a sheet flattening device in which the de-curling surfaces may be engaged by a freshly printed side of the sheet without the smearing of ink which has occurred in the past. It is a more specific object in this connection to provide a de-curling device in which the sheet is engaged by freely rotatable rollers having a two-dimensional pattern of shallow projections which, in addition to avoiding relative slippage, also minimize the amount of area contact with the surface of the sheet so that de-curling may be carried out while preserving the high quality of the printed image, a valuable feature where both sides of the sheet are printed at the same time.

It is another specific object of the present invention, in its preferred embodiment, to provide for positive rotation of the de-curling rollers by a connection with the press drive so that the surface speed of the rollers is always precisely the same as the conveyance speed of the sheets to preclude periodic roller slow-down, and tendency toward relative movement, during the gaps between serially spaced sheets.

It is a general object of the present invention to provide a flattening, or de-curling, device which overcomes the disadvantages of the devices used heretofore but which is, nonetheless, simple and economical in construction and capable of trouble-free operation without maintenance or adjustment over long periods of time.

Other objects and advantages of the invention will become apparent upon reading the attached detailed description and upon reference to the drawings in which:

FIG. 1 is a vertical cross section of a de-curling device constructed in accordance with the invention taken along line 1—1 in FIG. 3.

FIG. 2 is a fragmentary vertical section taken along line 2—2 in FIG. 1.

FIG. 3 is a fragmentary horizontal section taken along line 3—3 in FIG. 1.

FIG. 4 is a somewhat diagrammatc elevational view, in partial section, illustrating the sharp bend which accomplishes the de-curling and illustrating further an alternate form of the invention.

FIG. 5 is a fragmentary section taken through a rotating roller and showing the use of a two-dimensional pattern of shallow projections.

FIG. 6 is a view similar to FIG. 2 but showing positive driving of a rotatable de-curling roll.

FIG. 7 is a perspective view showing a filler piece which is employed to conserve vacuum where the sheet is of less than standard width.

While the invention has been described in connection with certain preferred embodiments, it will be understood that I do not intend to be limited to the particular embodiments shown but intend, on the contrary, to cover the various alternative and equivalent constructions included within the spirit and scope of the appended claims.

Turning now to FIGS. 1–4 there is shown a flattening, or de-curling, assembly 10 having a frame in the form of a supporting bar 11 having upstanding brackets 12 at its ends. Mounted upon the frame are a pair of elongated cylindrical members in the form of rollers 15, 16 which are rather closely spaced parallel to one another and which present opposed cylindrical surfaces 17, 18 which define an upper receiving space 21 of cusped cross section as well as a lower plenum space 22 which is also of cusped shape. Vacuum is applied to the lower space by means of a vacuum fitting 23 which is connected, via an adjustable pressure regulator valve 24, to a source of vacuum 25.

In use the device is supported parallel to and closely adjacent the path of flow of sheets S drawn, by a conveyor K having grippers G, from a source of sheets which may for example be a press P, with the sheets being deposited in a squared stack at a suitable receiver, for example, a delivery pile DP. The de-curler is arranged crosswise with respect to the direction of sheet movement, and on the "concave" side of a sheet which has a curling tendency C, to produce a sharp bend B in a direction which is opposite to the curl.

In accordance with the present invention at least the downstream one 15 of the rollers 15, 16 is mounted for rotational movement in the supporting bracket 12. Free rotational movement may be achieved by interposing a ball type anti-friction bearing 30 at each end of the roller, with the inner race of the bearing engaging a fixed stub shaft 31. In the preferred form of the invention, as illustrated in FIGS. 1–3, both of the rollers 15, 16 are made freely rotatable. For the purpose of sealing against leakage of vacuum between the supporting bar 11 and the rotating surfaces of the rollers longitudinal seals are provided in the form of resilient leaf spring elements 32, 33 which are anchored along the bar, and the free cantilevered edges of which have light wiping engagement with the surfaces of the respective rollers. The lower space 22, thus sealed, serves as a vacuum plenum, distributing the effect of the vacuum more or less evenly to the gap between the rollers.

The full advantage of the non-slip features of the present invention is obtained where the rotating rollers are roughened by surfacing them with an area-extensive pattern of closely spaced shallow projections as produced, for example, by knurling, to define a cylindrical supporting locus while minimizing the actual area in contact between the sheet and the supporting surface. This is illustrated in FIG. 5 which shows a fragment of the downstream roller, indicated at 15*a*, having a pattern of projections 35 shown engaging the printed underside of a sheet S. Because of point contact and lack of relative movement, the sheet may be engaged directly over a freshly printed impression without smearing or offset or otherwise affecting the quality of the impression. Thus the invention is particularly well adapted to removing residual curl from sheets which are printed on both sides at substantially the same time.

In accordance with one of the aspects of the present invention the rollers 15, 16, rather than simply being freely rotatable, may be positively driven at a peripheral speed which corresponds to the speed of conveyance. This is illustrated in FIG. 6 in which corresponding reference numerals are used, with the addition of subscript b. Here downstream roller 15*b* mounted upon a supporting bar 11*b* has a shaft 31*b* journaled in an anti-friction bearing 30*b* mounted in the end supporting bracket 12*b*. The shaft 31*b* is coupled by any suitable means 34 to the press drive using a drive ratio as required to produce the desired peripheral speed. Such constant "pre-drive" is particularly desirable in de-curling devices which engage a freshly printed side of the sheet since constant speed is assured even where there are gaps between serially spaced sheets, thereby avoiding the slight periodic slow-down which must occur where the rollers rely upon the sheet itself for rotational driving. To accommodate the momentary relative speed up in the velocity of the upstream roller 16*b* which occurs upon "draw-down" of the sheet into the cusp, an over-running clutch 35 is preferably included in the drive leading to such roller.

It will be apparent that while a roughened surface with shallow projections 35 minimizes the area effectively in contact, the invention is not limited thereto and, if desired, the rollers, for anti-smearing effect, may be smoothly surfaced and coated with Teflon or other anti-friction, anti-offset agent.

While it is preferred to have the width of the sheet coextensive with the length of the rollers, the uncurling device may nevertheless be employed with minor modification in the uncurling of sheets of less than standard width. Thus where the sheet being handled has a width which is less than the full length of the rollers, a filler piece 40 (FIG. 7) may be interposed between the bracket 12 and the adjacent, inwardly spaced, edge of the sheet. Such filler piece, shown as installed, has a body of inverted "U" shape, preferably formed of spring metal, and which is dimensioned to snap over and embrace the pair of rollers in the end position adjacent the bracket. Preferably the filler piece has a downwardly extending skirt 41 of cusp-shaped profile which extends downwardly between the rollers to block the triangular receiving space through which leakage would otherwise occur.

It will be seen that the objects of the invention have been amply fulfilled: The device imparts to a sheet a sharp bend B in a direction which is opposite the direction of curl C thereby neutralizing the curling tendency without development of any substantial friction or reaction force in the sheet and free of the relative movement which causes smearing in the case of engagement of a freshly printed side of the sheet. The pressure regulator 24 may be set to produce a high degree of vacuum and thus a high degree of anti-curling effect without the former limitations. Sheets are deposited flatly to form a neatly squared delivery pile without risk of folding-in at either the trailing or leading edge. Because of its advantages the present device has uniform application to presses of all types, sizes and speeds and, indeed, even outside of the press field where it is necessary to correct curl in transported sheets. Nevertheless the structure is simple and economical and capable of operation over long periods without care or maintenance.

The term "cylindrical member" or "roller" refers to a member presenting an engageable cylindrical surface. Since the device may be operated in any position, as long as the disclosed relation to the sheet is maintained, the terms "upper", "lower", and "upstanding" will be understood to be relative terms.

What I claim is:

1. A sheet flattener for a sheet-fed printing press or the like in which printed sheets having a tendency to curl in the direction of a freshly printed surface thereof are conveyed seriatim edgewise from a source to a receiver along a path of flow comprising, in combination, a pair of elongated smoothly cylindrical rollers closely spaced parallel to one another to form a narrow gap between them and presenting opposed cylindrical surfaces defining an upper receiving space and a lower plenum space of cusp-shaped cross section, means including a supporting bar having end brackets for rotatively supporting the rollers crosswise with respect to the direction of sheet flow and for defining a receiving space closely spaced parallel to the sheet path, means including the supporting bar and end brackets for enclosing and sealing the plenum space, means for applying vacuum in the plenum space, means for conveying the sheets along the path of movement to the surface of said pair of closely spaced rollers with a freshly printed surface of each sheet in contact with the surface of said rollers, the surface of the rollers being continuous and imperforate so that the effect of the vacuum is concentrated in the gap at a sufficiently high level as to draw a conveyed sheet downwardly into the upper receiving space and deeply into the narrow portion of the gap and against the cylindrical surfaces in a cusped profile with the sheet undergoing an abrupt bend at the point of the cusp in a direction opposite to the direction of curling tendency thereby to remove the curl, both of the rollers being mounted for rotational movement at the speed of conveyance of the sheet to preclude any drag and relative slippage of the sheet against the surfaces thereby to insure against smearing of ink on the presented faces of the sheets.

2. A sheet flattener for a sheet-fed printing press or the like in which printed sheets having a tendency to curl in the direction of a freshly printed surface thereof are conveyed seriatim edgewise from a source to a receiver along a path of flow comprising, in combination, a pair of elongated smoothly cylindrical rollers closely spaced parallel to one another to form a narrow gap between them and presenting opposed cylindrical surfaces defining an upper receiving space and a lower plenum space of cusp-shaped cross section, means including a supporting bar having end brackets for rotatively supporting the rollers crosswise with respect to the direction of sheet flow and for defining a receiving space closely spaced parallel to the sheet path, means including the supporting bar and end brackets for enclosing and sealing the plenum space, means for applying vacuum in the plenum space, means for conveying the sheets along the path of movement to the surface of said pair of closely space rollers with a freshly printed surface of each sheet in contact with the surface of said roller, the surface of the rollers being continuous and imperforate so that the effect of the vacuum is concentrated in the gap at a sufficiently high level as to draw a conveyed sheet downwardly into the upper receiving space and deeply into the narrow portion of the gap and against the cylindrical surfaces in a cusped profile with the sheet undergoing an abrupt bend at the point of the cusp in a direction opposite to the direction of curling tendency thereby to remove the curl, both of the rollers being mounted for rotational movement at the speed of conveyance of the sheet to preclude any drag and relative slippage of the sheet against the surfaces thereby to insure against smearing of ink on the presented faces of the sheets, and a filler piece extending between an edge of the sheet and the adjacent ends of the cylindrical rollers, the filler piece being dimensioned to enclose the portion of the evacuated gap which projects beyond the edge of the sheet and having an integral skirt of cusped profile which extends downwardly between the cylindrical rollers adjacent the edge of the sheet.

* * * * *